US005187336A

United States Patent [19]

Lang et al.

[11] Patent Number: 5,187,336

[45] Date of Patent: Feb. 16, 1993

[54] SWITCH ASSEMBLY WITH TRANSFER ACTUATOR

[75] Inventors: Harold K. Lang, Wheeling; Chockalingam Kumar, Antioch, both of Ill.

[73] Assignee: The Cherry Corporation, Waukegan, Ill.

[21] Appl. No.: 530,878

[22] Filed: May 30, 1990

[51] Int. Cl.[5] ..... H01H 3/16

[52] U.S. Cl. ..... 200/61.61; 200/61.59; 200/85 R; 200/332

[58] Field of Search ..... 200/52 R, 61.58 R, 61.59, 200/61.61, 61.62, 85 R, 409, 467, 302.1, 302.2, 302.3, 332, 335

[56] References Cited

U.S. PATENT DOCUMENTS

| | | | |
|---|---|---|---|
| 3,054,869 | 9/1962 | Everett | 200/52 R |
| 3,209,089 | 9/1965 | Weissburg | 200/16 A |
| 3,253,271 | 5/1966 | Trupiano et al. | 340/570 |
| 3,383,487 | 5/1968 | Wiener | 200/302.1 |
| 3,569,644 | 3/1971 | Brugger et al. | 200/61.61 |
| 3,586,810 | 6/1971 | Brown | 200/302.2 |
| 3,588,423 | 6/1971 | Hallerberg | 200/302.2 |
| 3,598,941 | 8/1971 | Nelson | 200/51.09 |
| 3,618,060 | 11/1971 | Nina | 340/396 |
| 3,713,670 | 1/1973 | Reynolds | 200/295 |
| 3,725,626 | 4/1973 | Kruse | 200/295 |
| 3,725,893 | 4/1973 | Malta et al. | 340/570 |
| 3,832,508 | 8/1974 | Beck | 200/332 |
| 3,913,087 | 10/1975 | McBrian | 340/568 |
| 3,997,750 | 12/1976 | Glazer | 200/302.2 |
| 4,006,336 | 2/1977 | Boyden | 200/246 |
| 4,072,841 | 2/1978 | Corfield | 200/332 |
| 4,143,254 | 3/1979 | Heyrana | 200/16 R |
| 4,238,656 | 12/1980 | Heyrana | 200/283 |
| 4,241,246 | 12/1980 | Lugaresi | 200/52 R |
| 4,335,286 | 6/1982 | Nelson | 200/302.1 |
| 4,362,916 | 12/1982 | Anderson | 200/332 |
| 4,385,215 | 5/1983 | Lemberg | 200/5 A |
| 4,394,553 | 7/1983 | Feil | 200/462 |
| 4,398,074 | 8/1983 | Danielson et al. | 200/302.2 |
| 4,414,440 | 11/1983 | DeCosta | 200/50 B |
| 4,439,654 | 3/1984 | Bresin et al. | 200/302.1 |
| 4,453,058 | 6/1984 | Miyata | 200/283 |
| 4,607,147 | 8/1986 | Ono et al. | 200/512 |
| 4,652,706 | 3/1987 | Rao et al. | 200/409 |
| 4,654,493 | 3/1987 | Drager et al. | 200/302.1 |
| 4,673,778 | 6/1987 | Lewandowski et al. | 200/467 |
| 4,772,767 | 9/1988 | Sawada | 200/302.3 |
| 4,796,007 | 1/1989 | Heys, Jr. | 341/31 |
| 4,839,474 | 6/1989 | Hayes-Pankhurst et al. | 200/5 A |
| 4,839,483 | 6/1989 | Doyle | 200/302.1 |
| 4,851,625 | 7/1989 | Liebich | 200/302.1 |
| 4,876,422 | 10/1989 | Kanezawa | 200/302.1 |

FOREIGN PATENT DOCUMENTS

| | | | |
|---|---|---|---|
| 1136160 | 12/1968 | United Kingdom . | |
| 1192437 | 5/1970 | United Kingdom . | |
| 1279381 | 6/1972 | United Kingdom | 200/61.7 |
| 1333034 | 10/1973 | United Kingdom | 200/61.7 |

*Primary Examiner*—J. R. Scott

*Attorney, Agent, or Firm*—Willian Brinks Olds Hofer Gilson & Lione

[57] ABSTRACT

An electrical switch assembly operable by means of a force applied in a first direction and including a switch having an switch actuator member responsive to a force applied thereto in a second direction orthogonal to the first direction. The switch assembly further comprises a transfer actuator having a force receiving portion facing the first direction and an end portion flexibly connected at a first end thereof to the force receiving portion and at a second end thereof bearing against a surface slidably in the second direction. A tab connected to the end portion and movable therewith is operably aligned with the switch actuator member. A force applied in the first direction to the force receiving portion of the transfer actuator is transferred to the second direction to operate the switch. This is accomplished by means of the transfer actuator having a shape that flattens out when a force is applied thereto from the first direction. It is this flattening out into the second direction, orthogonal to the first direction, which is utilized to operate the switch.

In a further aspect, there is provided a waterproof switch suitable for outdoor use having a housing having a flexible membrane forming a wall thereof, an electric switch located inside the housing and having leads connected thereto that extend from the inside to the outside of the housing, and a transfer actuator internal to the housing, adjacent to the membrane, and aligned to operate the electric switch.

19 Claims, 2 Drawing Sheets

SWITCH ASSEMBLY WITH TRANSFER ACTUATOR

BACKGROUND OF THE INVENTION

The present invention relates to an electric switch assembly and more particularly to an electric switch assembly adaptable for locations of limited size.

In general, switches are used to connect and disconnect the flow of electric current between two or more wires or leads. This may be done by mechanical means in which conductive parts are brought into or out of contact inside the body of the switch. This bringing into contact of the conductive parts is effected by a part of the switch that may be referred to as the actuation member. The actuation member is thus the part of the switch that is responsive to the application of an external mechanical force to effect the bringing into or out of contact the conductive parts inside the switch in order to connect or disconnect the flow of electricity between two or more wires.

Many different types of switches have been made and designed having different sizes and different configurations for the both the internal conductive parts and for the actuation member in order to provide the desired operating characteristics for the particular application at hand. The operating characteristics of the switch may include the size of the actuation member, the amount of force necessary to effect movement of the actuation member, the range of movement of the actuation member (referred to herein as the "throw"), and the point in the throw of the actuation member at which switching action of the conductive parts takes place.

One such application is the use of switches as sensors. Because the actuation member of a switch operates by application of an external force, switches can be used as sensors to detect the movement or position of an object by locating the switch actuation member so that movement of the object operates the actuation member thereby operating the switch. Detection of the switch operation can thus be monitored remotely by measuring a voltage across or a current through leads connected to the switch. In this manner, switches may be used in combination with or as part of other devices or systems to effect control or operation thereof or to determine the status or location of components of the device or system.

A particular application in which a switch may be used as a sensor relates to an alarm to detect tampering with a cash box in a public telephone. In order to alert police or security personnel about an attempt of pilferage in progress, a switch may be located behind the cash box. (If the switch were on the side of the cash box, it could be defeated). The leads from the switch are connected to a remote location and monitored. Removal of the cash box moves the switch actuator thus operating the switch. This can be detected in the remote location by measurement of the voltage across or current through the leads. Removal of the cash box by maintenance or service personnel can be authorized by dialing in an access number via the telephone to inform the personnel at the remote location that removal of the cash box is authorized.

A problem presented in using a switch for this purpose is that there is little room available for the switch, i.e. approximately less than ¼ inch. Any space that the switch occupies would detract from the volume available for the cash box. However, the switch to be used for this purpose should have a relatively large throw. Since the switch is intended to detect removal of the cash box which may be approximately 4 inches square, the actuation member should operate upon a movement of approximately an inch or more.

Switches have been made that are relatively small, i.e. that could fit behind the cash box. However, switches designed to be of such a miniature size tend to be expensive. Moreover, when switches are made to be of a smaller overall size, the size of the actuator as well as the amount of force required to effect switching and the "throw" of the actuator is typically reduced also. This presents a problem because even though the switch should be relatively small in a direction responsive to removal of the cash box, the switch should be responsive to only relatively large movements, e.g. an inch or more, of the cash box in that direction. With a typical switch of a size that is small enough to fit behind the cash box, a correspondingly small movement of the cash box in that direction could cause the switch to operate. Thus, small movements of the telephone unrelated to an attempt at pilferage could cause the switch to operate thus generating a false alarm. Moreover, if the switch actuation member has a small throw, the telephone cash box must have tolerances associated with its construction that correspond to those of the switch. This of course could lead to higher costs.

Another problem presented to the use of a switch for this purpose is that because pay telephones are often in an outdoor environment, there is a potential for moisture entering the switch and interfering with the operation thereof.

Accordingly, it is an object of the present invention to provide a switch that has a small profile relative to its actuation direction.

It is another object of the present invention to provide a switch that has a small profile relative to the throw of its actuation member.

It is yet another object of the present invention to provide a waterproof switch having a low profile.

It is still another object of the present invention to provide a waterproof switch that can be used in conjunction with a pay telephone to detect the removal therefrom of a cash box.

SUMMARY OF THE INVENTION

With these and other considerations taken into account, according to a first aspect of the present invention, there is provided an electric switch assembly operable by means of a force applied in a first direction and including a switch having an switch actuator member responsive to a force applied thereto in a second direction orthogonal to the first direction. The switch assembly further comprises a transfer actuator having a force receiving portion facing the first direction and an end portion flexibly connected at a first end thereof to the force receiving portion and at a second end thereof bearing against a surface slidably in the second direction. A tab connected to the end portion and movable therewith is operably aligned with the switch actuator member. A force applied in the first direction to the force receiving portion of the transfer actuator is translated to the second direction to operate the switch. This is accomplished by means of the transfer actuator having a shape that flattens out when a force is applied thereto from the first direction. It is this flattening out into the second direction, orthogonal to the first direction, which is utilized to accomplish operation of the switch.

According to a second aspect of the present invention, there is provided a waterproof switch suitable for outdoor use having a housing having a flexible membrane forming a wall thereof, an electric switch located inside the housing and having leads connected thereto that extend from the inside to the outside of the housing, and a transfer actuator internal to the housing, adjacent to the membrane, and aligned to operate the electric switch.

DETAILED DESCRIPTION OF THE PRESENTLY PREFERRED EMBODIMENTS

Figure 1:
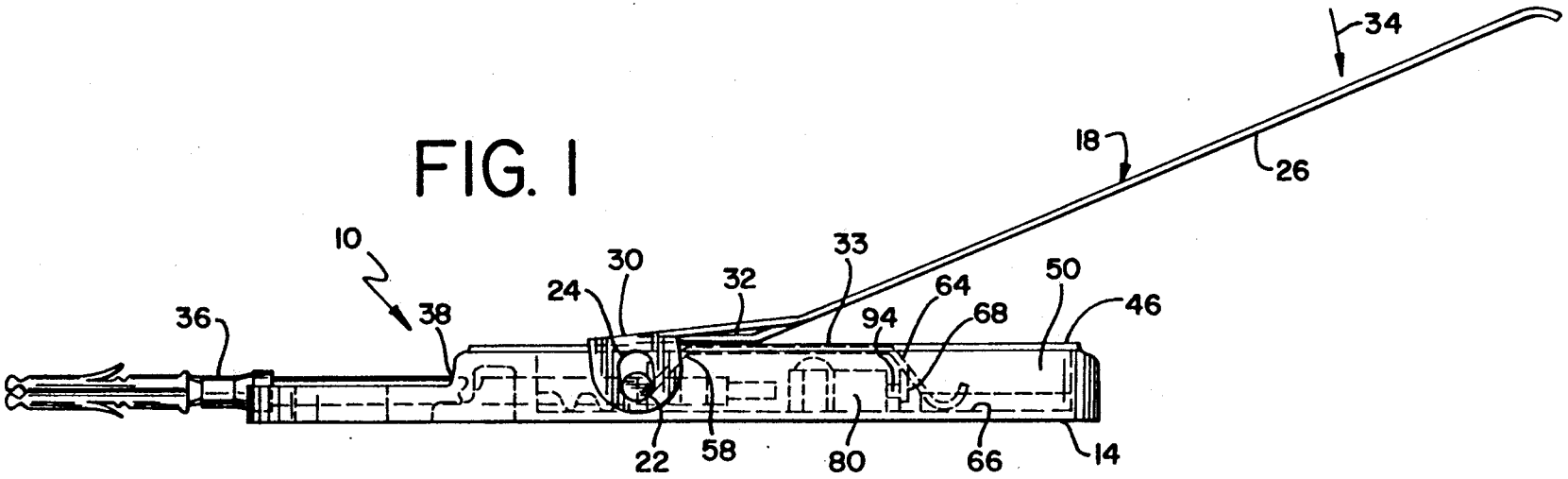
FIG. 1 is a side view of a first preferred embodiment of the present invention.

Referring to FIG. 1, a first preferred embodiment of the present invention is depicted generally as a switch assembly 10. The switch assembly 10 includes a housing 14 which is made of an insulative material such as a plastic. A suitable plastic that may be used for the housing is a liquid crystal polymer. Because this embodiment of the present invention may be used outdoors, the material used for the housing should be suitable for outdoor use. If used outdoors, the material should be water or moisture resistant or water or moisture proof depending upon the environmental conditions where the present invention will be deployed. If the present invention is intended for use in an indoor location, different, and perhaps less stringent, requirements as to temperature and moisture resistance may apply and different materials may be used for construction of the housing.

In the present embodiment, the switch assembly 10 provides the particular advantage that it has a narrow profile in the direction of actuation. Another way of describing this advantage is that the switch assembly is thin in the direction in which a force may be applied to operate the switch. Referring to FIG. 1, the housing 14 of the switch assembly 10 has a narrow dimension d. In the presently preferred embodiment, the dimension d is approximately 3/16" inches. The switch assembly has a length of approximately 1⅝" and a width (when viewed from the top, e.g. in FIG. 2) of approximately ¾". These dimensions are for the presently preferred embodiment and it is understood that the present invention could be made with dimensions other than these. Accordingly, it may not necessarily always be the case that the present invention would be narrower in dimension in the direction of actuation than in the other directions.

The switch assembly 10 further includes an external actuator arm 18. The external actuator arm 18 is used for the operation of the switch assembly by the application of an external force thereto. The external actuator arm 18 is connected to the housing 14 by pivot pins 22 that extend from the sides 23 of the housing 14 on either side thereof. The pivot pins 22 engage slotted holes 24 on a lower portion 30 of the external actuator arm 18. The lower portion 30 generally conforms to the housing body 14. The external actuator arm 18 also includes an upper portion 26 which in this embodiment extends diagonally from the lower portion 30 forming an angle of approximately 30 degrees thereto. The upper portion 26 is approximately 2" long. The external actuator arm 18 is made of a durable, resilient material such as a metal. As mentioned above with respect to the housing, if the present invention will be used outdoors, this factor should be given consideration when choosing a material for use as an external, actuator arm. In this embodiment stainless steel is used because of the potential exposure to moisture. However, other materials may also be suitable such as other metals or even nonmetallic materials.

Connection of the external actuator arm 18 to the housing is made so that a portion 32 of the external actuator arm 18 bears against the upper side 33 of the housing 14. The portion 32 may be bent so that when the external actuator arm is installed on the housing 14 by engagement onto the pins 22, the portion 32 forms a leaf-type spring that biases the external actuator arm 18 against the upper side 33 of the housing 14. Thus, when so installed the upper portion 26 of the external actuator arm 18 is biased into an upward position by the spring-like forces applied by the portion 32 bearing down on the upper side 33 of the housing 14. When an external force is applied in a direction indicated by the arrow 34 to depress the upper portion 26 of the external actuator arm 18, the force is transferred to the upper side 33 of the housing by the portion 32.

Extending from an end 35 of the housing are electrical leads **36*a* and 36*b*. These leads extend through an opening 38 in the end 35 of the housing to the interior thereof. A sealant is installed in the opening 38 around the leads 36A and 36B. If resistance to moisture is a consideration, the sealant should be water-proof to form a water-tight seal around the leads in the opening 38**. A suitable sealant may be a thermoset epoxy.

Figure 2:
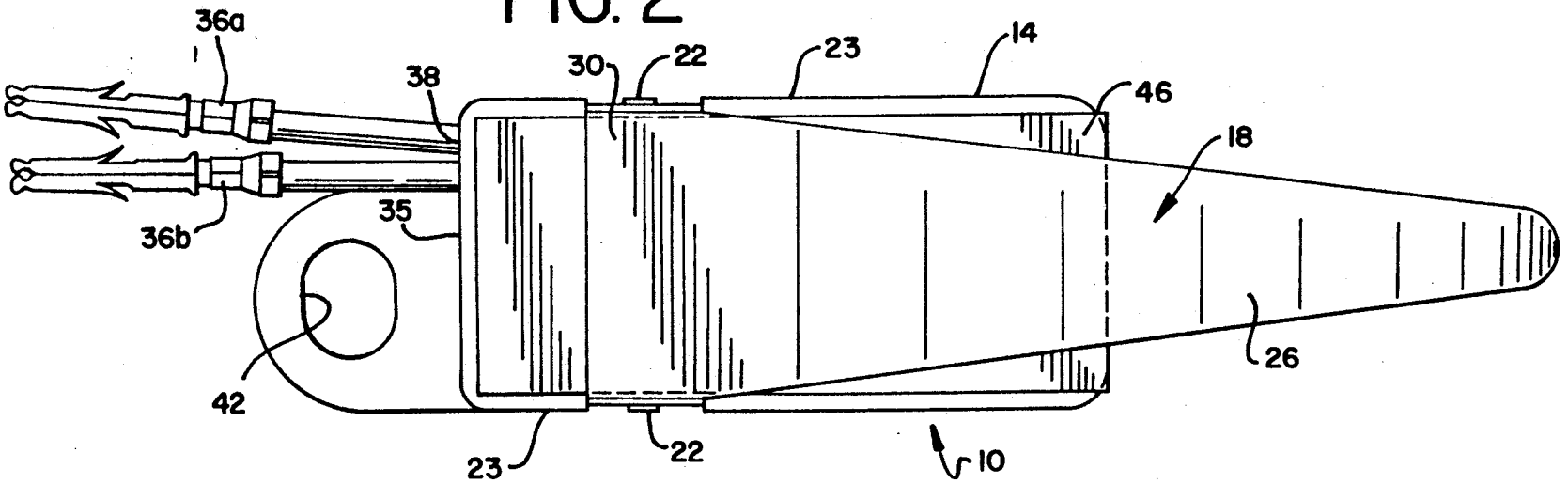
FIG. 2 is a top view of the embodiment of the invention depicted in FIG. 1.

The housing 14 also includes a means for mounting which in the embodiment depicted in FIG. 2 is an opening 42. The opening 42 may extend from one side of the housing to an opposite side thereto. The opening 42 is for the purpose of attaching and/or mounting the switch assembly 10 inside of a panel or unit, such as a telephone, where the switch assembly will be used. Fastening of the switch assembly to a unit would be provided to secure the switch thereto and also to fix the location of the switch for purposes of alignment of the actuation arm. In use in connection with cash boxes in pay telephones, the switch assembly would be connected by a fastening device, such a screw or bolt or the like through the opening 42 behind the cash box.

Extending over the top of the housing 14 is a membrane 46. The membrane 46 covers a portion of the upper side 33 of the housing 14 and is located between the housing 14 and the external actuator arm 18. As mentioned above, if the present invention is intended for use outdoors, the membrane 46 should be moisture resistant and provide a water-tight seal therearound. The membrane 46 is a made of a moderately flexible material so that application of force to one side of the membrane 46 will cause the membrane to flex, bend, or stretch or otherwise resiliently deform, thereby allowing the force so applied to be readily transmitted from one side of the membrane to the other. A suitable material for the membrane is silicon, polyester, or rubber.

Figure 3:
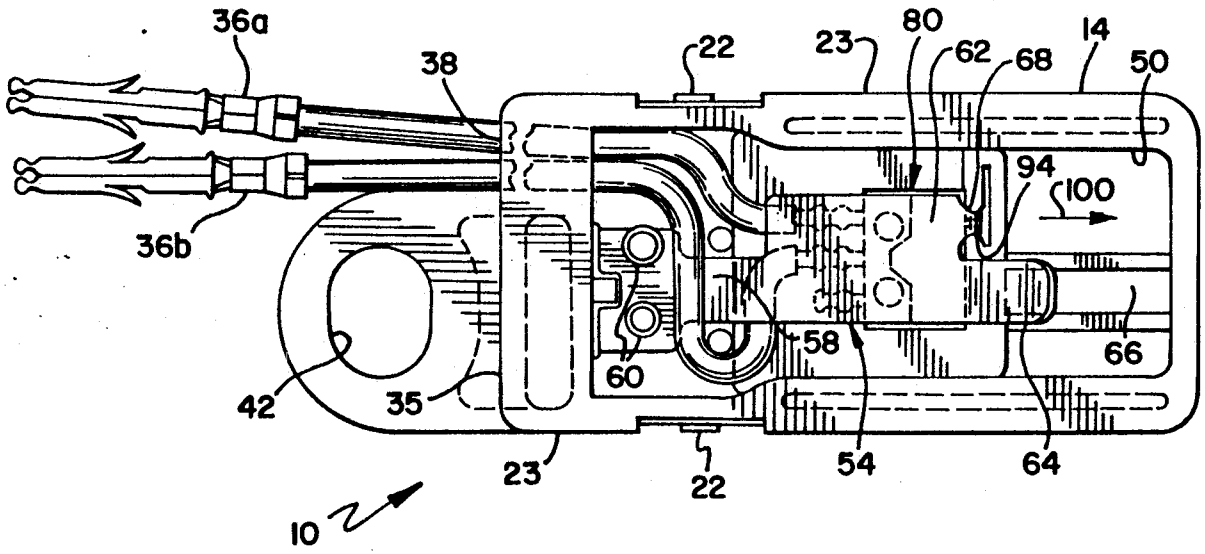
FIG. 3 is a top view of the embodiment depicted in FIGS. 1 and 2 with the external actuator and the membrane removed to show the components inside.

Referring to FIG. 3, this view shows the interior of the housing 14 with the membrane 46 and actuator arm 18 removed. Inside the housing 14 is a chamber 50. The chamber may be rectangular in shape and may conform generally to the dimensions of the housing 14. Fixed inside the chamber 50 is a transfer actuator 54. The transfer actuator 54 is attached at an end 58 thereof to the housing 14 by means of fasteners 60, such as heat staked plastic posts. The transfer actuator 54 is made of a flexible, resilient material. In the preferred embodiment the transfer actuator 54 is made of a metal. A suitable metal is stainless steel. In addition to the attached end 58, the transfer actuator 54 also includes a force receiving portion 62 and a slidable end portion 64. As seen from the side (e.g., FIG. 1), the force receiving portion 62 is located between the attached end 58 and the slidable end portion 64. The slidable end portion 64 is movable and bears against the inside of the housing 14. Preferably the slidable end travels in a groove 66 formed in the surface of chamber 50. As depicted in FIG. 1, the attached end 58 and the slidable end portion 64 each form an obtuse angle with the force receiving portion 62 so that when a force is applied to the force receiving portion 62 in the direction indicated by arrow 34, the transfer actuator 54 will tend to flatten out. In this embodiment, both the attached end 58 and the slidable end portion 64 form angles of approximately 135° with the force receiving portion 62. The force receiving portion 62 is located in the chamber 50 of the housing adjacent to the membrane 46 and directly opposite to the bearing portion 32 of the external actuator arm 18.

The transfer actuator further includes a tab 68. The tab 68 is connected to and moves with the slidable end 64 of the transfer actuator 54. In the preferred embodiment, the tab is also connected to the force receiving portion. The tab 68 operates an internal switch 80 fastened in the chamber 50, as explained below.

Figure 4:
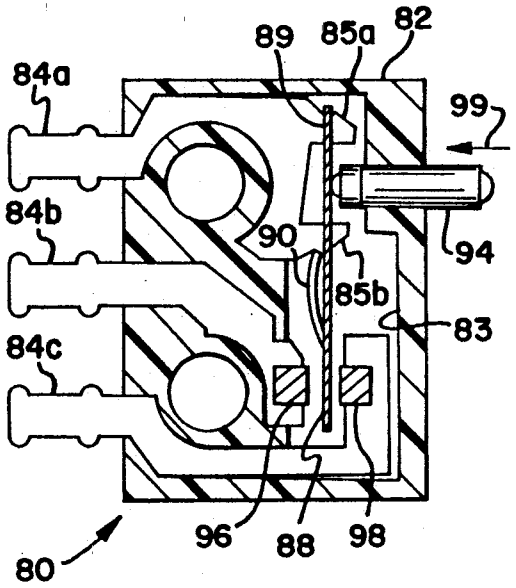
FIG. 4 is a sectional view of the internal switch used in the embodiments depicted in FIGS. 1 through 3.

Referring to FIG. 4 this is a cutaway sectional view of the internal switch 80. In the preferred embodiment, the internal switch is a single-throw-double-pole type switch and further is a snap-action type switch (i.e., the switch will remain in a first state until a force of a sufficient predetermined size is applied thereto at which time the switch will "snap" into the opposite state. The switch will then remain in the opposite state only for so long as the force continues to be applied; upon removal of the force, the switch returns to the first state). In the preferred embodiment of the present invention, the internal switch operates so that in the first state (i.e. without a force applied thereto) the switch is open. This condition is reversed once the entire switch assembly is installed behind a telephone cash box, as explained below. Although the present invention is described in terms of an embodiment having an internal switch of the single-throw, double-pole, snap-action type, other types of switches having operating characteristics different from these may be used as well.

The internal switch 80 includes an internal switch housing body 82 made of an insulative material. A suitable material is polyester. Inside the housing body 82 is a chamber 83.

The internal switch 80 includes three terminals: a common terminal 84*a* and two switching terminals 84*b* and 84*c*. Three terminals are provided in this embodiment although only two may normally be used. This is because the internal switch may be operated so that the first state of the switch (i.e. without an application of force applied thereto) can be chosen to be either "on" or "off" and the second state (i.e. with a force applied thereto) can be the opposite (i.e. "off" or "on"). Accordingly, depending upon the operation desired, the switch 80 can be wired so that either of these operating conditions obtain. In the present embodiment, the operation of the switch desired is that the internal switch is "off" (i.e. "open") in the first state and "on" (i.e. "closed") in the second state.

These terminals are made of a conductive material, e.g. metal. These terminals are individually fixed to the housing body 82 and extend from the chamber 83 inside of the housing body 82, through the wall of the housing body, and to the outside thereof. A blade 88 is attached to prongs 85*a* and 85*b* that form part of the inside portion of the common terminal 84*a*. The blade 88 is made of flexibly resilient conductive material. One end 89 of the blade 88 is connected to the prong 85*a*. A C-spring 90 is connected at one end thereof to the blade 88 (or may preferably be formed of a portion thereof) and bears at the other end thereof against the prong 85*b*. The C-spring 90 biases the blade 88 into contact against a contact 98 attached to the inner portion of terminal 84*c*.

A switch actuator member 94, which in the present embodiment is a button, extends through the housing body 82 and has an inside end that abuts the blade 88 between the prongs 85*a* and 85*b*. When a force is applied to the switch actuator member 94 in the direction indicated by the arrow 99, it is transferred to the blade 88. When the force is sufficient enough to overcome the biasing of the C-spring 90, the C-spring snaps into a reverse position so that the blade 88 is then forced into contact against contact 96 attached to the inside portion of terminal 84*b*. When the force applied to the switch actuator member 94 is removed (or sufficiently decreased), the biasing action of the C-spring 90 forces the blade 88 back into contact with the contact 98.

In the present embodiment, the lead 36*a* is connected to the terminal 84*a* and the lead 36*b* is connected to the terminal 84*b*. The connection of the leads 36*a* and 36*b* is shown in shadow in FIG. 3. No connection is made to the terminal 84*c* in the preferred embodiment. However, in different applications in which different operating characteristics are desired, a connection to terminal 84*c* may be made. As is evident from an examination of FIG. 4 and the description above, connection to the terminal 84*c* provides an "on" condition in the first state and an "off" condition in the second state. Thus, if by a choice of design the lead 36*b* were connected to the contact 84*c*, operation of the switch would be exactly the opposite. It may be desired to either open or close the switch upon application of a force to the external actuator and either condition can be obtained with the present invention.

Referring again to FIG. 3, the transfer actuator 54 is fixed in the housing 14 so that the tab 68 is aligned with and bears upon the switch actuator member 94. Thus, the transfer actuator 54, by reason of its being affixed inside the housing 14, applies a force upon the switch actuator member 94 causing it be in a second state (which in the presently preferred embodiment is the "on" position).

In operation, after the switch assembly 10 has been assembled and the membrane 46 sealed on the housing 14, a force in a first direction indicated by the arrow 34 applied to the external actuator arm 18 to depress it transfers through the flexible membrane 46 to operate the transfer actuator 54. A force on the force receiving portion 62 of the transfer actuator 54 causes the slidable end 64 and the tab 68 to move in a direction orthogonal to the force applied upon the transfer actuator 54. The tab 68 moves in the direction 100 opposite to that indicated by the arrow 99. This operates the internal switch 80 by removing the force applied to the switch actuator member 94 thereby causing it to switch into the first state. Inside the internal switch 80, when a force is applied to the external actuator 18, by transference of the force through the switch assembly, the C-spring 90 brings the blade 88 out of contact with the contact 96 and into contact with the contact 98.

The present invention provides several unique advantages. The present invention makes these advantages possible by transferring the actuation force from a first direction to a second direction. This is applied in the preferred embodiment by transferring the actuation force from a first direction in which the dimension of the switch is critical to a second direction in which the dimension of the switch is less critical and then providing an internal switch with the desired operating characteristics oriented in the less critical direction. In the particular application at hand, i.e. for a telephone cash box, a switch responsive to an actuation force in a first direction and having the desired operating characteristics could not be readily provided at a relatively low cost. With the present invention, a transfer of direction of the actuation forces occurs so that the desired operating characteristics can be provided. In this case, the desired operating characteristics include moisture-resistance, a throw relatively larger than the switch housing profile, and "snap-action" operation.

The advantages provided by the present invention by the transfer of the force of actuation from a first to a second direction, may be extended to many other applications so that the operating characteristics of the switch can be readily and freely selected with fewer concerns for constraints imposed by the geometry, location, etc. on the profile of the switch. Thus the switch can be readily specifically tailored to the requirements of the application at hand, i.e. made small, yet a wide range of operating characteristics of the switch can be provided.

As can be appreciated, the size, throw, and force of actuation of the external actuation member can also be selected to assist in establishing the desired operating characteristics. For example, by making the bearing portion 32 deeper, a shorter throw would be required to operate the switch.

It can be further appreciated that an advantage of the present invention is that a range and variety of operating characteristic may be obtained by modification of the external actuator without modification of the sealed housing. Thus, the sealed housing with the internal switch inside can be treated as a standardized stock component item that may be used in various applications requiring different operating characteristics. Advantages related to reduced tooling and stocking may thus be obtained.

It is intended that the foregoing detailed description be regarded as illustrative rather than limiting, and that it be understood that it is the following claims, including all equivalents, which are intended to define the scope of the invention.

We claim:

1. A switch assembly comprising:

a housing having a flexible membrane forming a wall thereof and facing a first direction to receive a force applied therefrom;

an electric switch located inside said housing and having a switch actuation member responsive to the application of force in a second direction, said second direction orthogonal to said first direction, and further in which said electrical switch has leads connected thereto that extend from the inside to the outside of said housing;

a transfer actuator member located inside said housing adjacent to said membrane, said transfer actuator member having a portion aligned to receive said force via the membrane and also having a portion aligned to operate said electric switch; whereby a force applied to said membrane from the outside of said housing is transferred to said switch actuator member via said transfer actuation member to effect operation of said switch.

2. The switch assembly of claim 1 further comprising:

an external actuator lever operably located to bear upon said membrane to apply a force to said transfer actuator member.

3. The switch assembly of claim 2 in which said external actuator is pivotally connected to said housing.

4. The switch assembly of claim 3 in which said external actuator further comprises:

a first lower portion pivotally connected to said housing;

a second lower portion connected to said first lower portion and bearing upon said membrane directly opposite from said transfer actuator; and an upper portion connected to said lower portion and forming an angle thereto, said upper portion responsive to a force applied thereto in a first direction.

5. The switch assembly of claim 1 in which said housing is waterproof.

6. The switch assembly of claim 1 in which said switch is a snap action switch.

7. The switch assembly of claim 6 in which said switch further comprises:

a housing;

a first terminal affixed to said housing and passing from the inside to the exterior thereof, said first terminal connected to one lead;

a second terminal affixed to said housing and passing from the inside to the exterior thereof, said second terminal connected to another lead;

a blade connected at one end thereof to said first terminal inside said housing, said blade having another end movable into contact with the portion of said second terminal inside said housing;

a C-spring positioned to bias said blade against an inside portion of said switch actuator member.

8. The switch assembly of claim 1 in which said switch is a single pole double throw switch.

9. An electrical switch assembly for the actuation of a switch by an external force applied in a first direction comprising:

an internal switch mounted within a housing and having a switch actuator member responsive to the application of a force in a second direction, said second direction orthogonal to said first direction;

a housing surface adjacent to said internal switch and oriented facing at least in part in said first direction; and a transfer actuator comprising:

a force receiving portion facing a first direction;

a slidable end portion flexibly connected at a first end thereof to said force receiving portion and at a second end thereof bearing against said housing surface slidably in said second direction; and a tab connected to said slidable end portion and movable therewith, said tab operably aligned with said switch actuator member;

whereby said internal switch is operated by application of a force to said transfer actuator in said first direction.

10. The switch assembly of claim 9 in which said transfer actuator further comprises:

a fastening end connected to said force receiving portion and also connected to said housing surface.

11. The switch assembly of claim 9 in which said tab is in contact with and bears upon the switch actuation member in the absence of a force applied to said force receiving portion and said tab is displaced in said second direction reducing the force applied upon said switch actuation member when a force in said first direction is applied to said force receiving portion thereby causing said internal switch to switch from one state to another state.

12. An apparatus for use in a switch assembly for translating the direction of the switch actuation force from a first direction to a second direction orthogonal to said first direction in order to operate a switch having a switch actuation member responsive to the application of a force in the second direction and in which the switch is mounted adjacent a housing surface oriented in the first direction, comprising:

a force receiving portion facing the first direction;

an end portion flexibly connected at a first end thereof to said force receiving portion and at the second end thereof slidably bearing against the housing surface in said second direction; and a tab connected to said end portion and movable therewith, said tab operably aligned with the switch actuator member, whereby said switch is operated by application of a force to said force receiving potion in said first direction.

13. The apparatus of claim 12 in which said force receiving portion and said end portion are connected together forming an obtuse angle so that a force applied to said force receiving portion in the first direction causes a flattening of the angle formed by the connected of said force receiving portion and said end portion and further causes the second end of said end portion to be displaced in the second direction by slidably bearing against the housing surface.

14. The apparatus of claim 13 further comprising:

a housing having a chamber therein defined in part by said housing surface and further in which the switch is located in said chamber and connected to said housing.

15. The apparatus of claim 14 in which said housing further includes a groove in the housing surface of said chamber, said groove oriented in said second direction, and further in which said second end of said end portion is slidable in said groove upon the application of a force in the first direction applied to said force receiving portion.

16. The apparatus of claim 15 further comprising:

a second end portion connected to said force receiving portion on an opposite end thereof from said first end portion, said second end portion forming an obtuse angle with said force receiving portion, and further in which said second end portion is connected to said housing inside said chamber.

17. An apparatus for effecting the operation of a switch by means of a force applied in a first direction, the switch having a switch actuator member responsive to a force applied thereto in a second direction, said second direction orthogonal to said first direction, said apparatus comprising:

a force receiving portion facing said first direction;

an end portion flexibly connected at a first end thereof to said force receiving portion and at a second end thereof bearing against a surface located adjacent thereto slidably in said second direction; and a tab connected to said end portion and movable therewith, said tab operably aligned with the switch actuator member, whereby the switch is operated by application of a force to said force receiving portion in said first direction.

18. A switch assembly for use in combination with a cash box comprising:

a housing connected to a surface adjacent to the cash box, said housing having a flexible membrane forming a wall thereof and facing a first direction toward the cash box;

an electric switch located inside said housing and having a switch actuation member responsive to the application of force in a second direction, said second direction orthogonal to said first direction, and further in which said electrical switch has leads connected thereto that extend from the inside to the outside of said housing, and further in which said leads are connected to a remote location for monitoring the position of the cash box;

a transfer actuator member located inside said housing adjacent to said membrane, said transfer actuator member having a first portion aligned to receive a force applied thereupon through said membrane and a second portion adapted to move in the second direction in response said force to operate said electric switch; and an external actuator lever pivotally connected to said housing and operably located to bear upon said membrane to apply a force to said transfer actuator member when a cash box is in position adjacent to said housing; whereby the removal of the cash box is monitored from the remote location by the measurement of at least one of the voltage across said leads and the current through said leads.

19. An electrical switch assembly that can be actuated by an external force applied in a first direction comprising:

a housing;

an internal switch mounted within said housing and having a switch actuator member responsive to the application of a force in a second direction, said second direction orthogonal to said first direction; and an internal transfer actuation member mounted in said housing and comprising:

a first portion facing the first direction for receiving a force therefrom; and a second portion connected to the first portion and operably aligned with said switch actuator member, said transfer actuation member adapted to resiliently deform by bending upon application of a force upon the first portion to move the second portion to operate the switch actuation member;

an external actuator connected to the internal switch and mounted externally of said housing, said external actuator having a first portion aligned to receive a force applied thereto in the first direction, and a second portion adjacent to the first portion of the internal transfer actuation member and adapted to bear upon the first portion of the internal transfer actuation member upon application of a force to the first portion of the external actuator.

* * * * *

UNITED STATES PATENT AND TRADEMARK OFFICE

CERTIFICATE OF CORRECTION

PATENT NO. : 5,187,336
DATED : February 16, 1993
INVENTOR(S) : Harold K. Lang et al.

It is certified that error appears in the above-indentified patent and that said Letters Patent is hereby corrected as shown below:

IN THE TITLE PAGE (Item 57)

In column 2, line 3 of the "ABSTRACT", delete "an" and substitute --a--.

In column 1, line 24, delete "the".

In column 2, line 52, delete "an" and substitute --a--.

In column 4, line 36, delete "water-proof" and substitute --waterproof--.

In column 4, line 51, after "such" insert --as--.

In column 4, line 60, delete the first occurrence of "a".

In column 6, line 58, after "it" insert --to--.

UNITED STATES PATENT AND TRADEMARK OFFICE

CERTIFICATE OF CORRECTION

PATENT NO. : 5,187,336

DATED : February 16, 1993

INVENTOR(S) : Harold K. Lang, et al.

It is certified that error appears in the above-indentified patent and that said Letters Patent is hereby corrected as shown below:

Column 7, line 50, delete "characteristic" and insert--characteristics--.

Signed and Sealed this

Eleventh Day of October, 1994

*Attest:*

Bruce Lehman

BRUCE LEHMAN

*Attesting Officer*

*Commissioner of Patents and Trademarks*